US007131747B1

(12) United States Patent
Yates

(10) Patent No.: US 7,131,747 B1
(45) Date of Patent: Nov. 7, 2006

(54) LENGTH ADJUSTMENT DEVICE FOR ILLUMINATED FASCIA

(76) Inventor: James P. Yates, P.O. Box 470, Charleston, IL (US) 61920

( * ) Notice: Subject to any disclaimer, the term of this patent is extended or adjusted under 35 U.S.C. 154(b) by 248 days.

(21) Appl. No.: 10/746,637

(22) Filed: Dec. 29, 2003

(51) Int. Cl.
*F21S 4/00* (2006.01)

(52) U.S. Cl. ..... 362/219; 362/225; 362/239

(58) Field of Classification Search ..... 362/146, 362/151, 152, 219, 239
See application file for complete search history.

(56) References Cited

U.S. PATENT DOCUMENTS

| | | | | |
|---|---|---|---|---|
| 2,708,711 | A * | 5/1955 | McGinty et al. | 362/151 |
| 3,131,871 | A * | 5/1964 | Foulds | 362/146 |
| 3,748,455 | A * | 7/1973 | Welton | 362/97 |
| 4,338,653 | A * | 7/1982 | Marrero | 362/223 |
| 4,574,336 | A * | 3/1986 | Mikalonis | 362/479 |
| 4,602,448 | A * | 7/1986 | Grove | 40/541 |
| 4,858,087 | A * | 8/1989 | Hartshorn | 362/219 |
| 5,260,859 | A * | 11/1993 | Lettenmayer | 362/219 |
| 5,584,566 | A * | 12/1996 | Bowman et al. | 362/220 |
| 5,628,557 | A * | 5/1997 | Huang | 362/252 |
| 6,183,104 | B1 * | 2/2001 | Ferrara | 362/145 |
| 6,425,676 | B1 * | 7/2002 | Lyons | 362/152 |
| 6,435,697 | B1 * | 8/2002 | Simmons et al. | 362/219 |
| 6,739,735 | B1 * | 5/2004 | Talamo et al. | 362/249 |
| 6,773,140 | B1 * | 8/2004 | Lee | 362/249 |
| 6,793,369 | B1 * | 9/2004 | Calzaretta et al. | 362/219 |

* cited by examiner

*Primary Examiner*—Ali Alavi
*Assistant Examiner*—Hargobind S. Sawhney
(74) *Attorney, Agent, or Firm*—Kenneth E. Darnell

(57) ABSTRACT

Apparatus permitting adjustment of the length of a section of an illuminated sign such as is used to provide a visual indication of a particular service provided by a given vendor, such as a vendor of service station products and services, the invention provides for fitting of a last section of a succession of sections to a particular lengthwise dimension mandated by the structure to which the illuminated sign is mounted. Illumination sources, particularly sets of light emitting diodes, cause both forwardly and rearwardly directed light to be respectively diffused through a diffuser or reflected from a surface to which the sign is mounted to provide a glow yielding the intended visual affect. At least certain of the light emitting diodes are mounted by sliding elements movable along an elongated track to permit location of said light emitting diodes in an appropriate location within a section which has been trimmed to an appropriate length, thereby providing a desired illumination along the length of the trimmed section or along the length of a section which does not require adjustment of its lengthwise dimension.

32 Claims, 4 Drawing Sheets

LENGTH ADJUSTMENT DEVICE FOR ILLUMINATED FASCIA

BACKGROUND OF THE INVENTION

1. Field of the Invention

The invention relates generally to visual displays such as are used about upper portions of a periphery of building structure such as a service station to provide a degree of illumination and a visual indication assocaited with a particular vendor or the like, the invention particularly relating to an illuminated fascia of a canopy or the like having light emitting diodes as the illumination source mounted by sections at least one of which can be trimmed to length as necessary to fit within a succession of sections intended to accommodate particular dimensions of an installation.

2. Description of the Prior Art

Buildings are commonly provided with illuminated fascia intended primarily to provide a visual indication of a commercial service associated with a particular vendor, such illuminated fascia typically being disposed about upper peripheral portions of a building with which commercial activity is associated. In particular, service station installations which include pumps for dispensing gasoline and the like are typically provided with building structure which surmounts and effectively shelters the pumps. As an identification of the particular vendor providing products and services at a particular location, illuminated fascia having particular coloration is disposed about the upper periphery of the building so that a potential user of such products and services can identify the source of the products and services and be guided to the location. In the prior art, various illumination sources, particularly incandescent and fluorescent illumination sources, have been used to produce light at least some of which is diffused through a colored diffuser and some of which is reflected from surfaces to which the diffuser and the light sources are mounted with the result being that a visual signal of at least one color is produced. The illumination so provided is intended to be attractive and part of an architectural statement made by the overall design of the service station or the like. Considerable practical problems exist with prior art illuminated fascia of this kind since incandescent and fluorescent light sources frequently require replacement due to the relatively short operational life thereof, it being necessary for a worker to scale a ladder to reach the elevated location of the illuminated fascia for changeout of a burned out lamp. Further, during installation of such illuminated fascia, it is often necessary to trim at least one section of a succession of sections of such illuminated fascia to a particular lengthwise dimension so that the length of the overall fascia can be caused to fit the lengthwise dimension of the building to which the fascia is mounted. In such situations, it is desirable to enable utilization of a single section both for fascia sections which can remain a full given length and for that section which must be trimmed to a particular lengthwise dimension in order to result in a desired fully installed length. Such a standard section which is capable of use with or without trimming must be configured so that the illumination provided in both the trimmed and untrimmed conditions is relatively constant along the full length of such sections. Existing illuminated fascia are presently produced commercially by entities such as Marketing Displays, Inc., a number of patents being assigned to this corporation such as U.S. Pat. No. RE 36,039 to Hillstrom et al, this patent disclosing a colored translucent body functioning as a light dispersion member such that light produced by illumination sources within the translucent body is diffused through said body to provide a visual signal of at least one color. Such illuminated fascia systems used at service stations and the like also typically provide backlighting which is reflected from fascia panels formed on surfaces of a building per se, the fascia panels reflecting light which can be the same or a different color from the colored light diffused through the translucent body forming a portion of the illuminated fascia. While the prior art has provided illuminated fascia useful in the manner so described, a long-felt need has been experienced in this field for advancements in the art which would reduce the need for frequent replacement of light sources and for improved installation of such illuminated fascia so that differing lengths of overall installations can be readily accommodated with desired illumination levels along full lengths of such installations. The present invention intends improvement of the art to the end of providing solutions to such long-felt needs.

SUMMARY OF THE INVENTION

The invention provides in a preferred embodiment an illuminated section used to form through endwise assembly with adjacent illuminated sections of preferably identical configuration a length of an illuminated fascia of essentially any given lengthwise dimension so that a given dimension of an exterior portion of a building such as a service station pump superstructure can be accommodated. The illuminated sections of the invention are typically formed with an elongated strip preferably extruded of aluminum and having track elements formed thereon. This structural strip also mounts illumination sources, particularly light emitting diodes, one set of light emitting diodes providing forwardly directed light while a second set of light emitting diodes provides rearwardly directed light. The forwardly directed light is diffused through a diffusive shell which is mounted to the elongated strip. The diffusive shell and the elongated strip can be cut to size depending upon the length of a "last" section needed for makeup of a length of successive sections necessary to accommodate a given dimension of a building or the like. The assembly formed by the diffusive shell and the elongated strip is mounted by conventional mounting elements to the face of a building and preferably in relation to a reflective element disposed against building surfaces or located behind the assembly such that rearwardly directed light from one set of the light emitting diodes is reflected to produce a glow from behind the assembly. Light from one set of the light emitting diodes passing through the illuminated sections of an installation also provides a glow by virtue of diffusion through the particular translucent material forming the diffusive shell. The material chosen for the translucent body and for the reflective fascia permits the production of desired visual affects of either differing or the same color depending upon the requirements of a particular installation.

An illuminated section configured according to the invention is further provided with sliding elements movable along one end thereof, one of the sliding elements being located on a forward face of the elongated strip and having a set of light emitting diodes disposed thereon for directing light forwardly through the diffusive shell. A second sliding element is mounted for sliding movement along a rearwardly oriented face of the elongated strip and is provided with a second set of light emitting diodes for directing light rearwardly against a reflective fascia member disposed rearwardly of the canopy section. In the event that the illuminated section is used in a succession of sections at a full length, the sliding elements are moved to locations at the full extent of one end of said section so that light emitting diodes are disposed on both sides of the elongated strip at appropriate locations for providing desired illumination. Trimming of the length of one of the illuminated sections as described herein causes the section to be of a lesser length than normal, each of the sliding elements being thereby located along the cut-off end of the section at locations providing appropriate illumination. The sliding elements can be located within a trimmed or untrimmed section at the appropriate location necessary to produce illumination providing the intended visual affects of an illuminated installation.

Accordingly, it is an object of the invention to provide illuminated signage such as is embodied in a fascia of a building such as a service station canopy and having light emitting diodes as light sources for providing both forwardly directed light and rearwardly directed light so that a desired visual affect can be produced.

It is another object of the invention to provide illuminated signage such as a canopy having illuminated sections of a standard length which can be trimmed as necessary for fitting within a succession of canopy sections to accommodate a particular lengthwise dimension mandated by the structure to which the illuminated signage is mounted.

It is a further object of the invention to provide an illuminated section having an elongated strip formed with tracks thereon and with sliding elements movable along the tracks of the elongated strip, both the elongated strip and the sliding elements having light emitting diodes disposed on surfaces thereof for providing both forwardly and rearwardly directed light if desired, the section being trimmable to a given length with the sliding elements having the positions thereof adjusted depending upon the length to which the section is trimmed, thereby to locate light emitting diodes in appropriate positions for producing even illumination.

Further objects and advantages of the invention can be appreciated from consideration of the following detailed description of the preferred embodiments of the invention.

DESCRIPTION OF THE PREFERRED EMBODIMENTS

Figure 1:
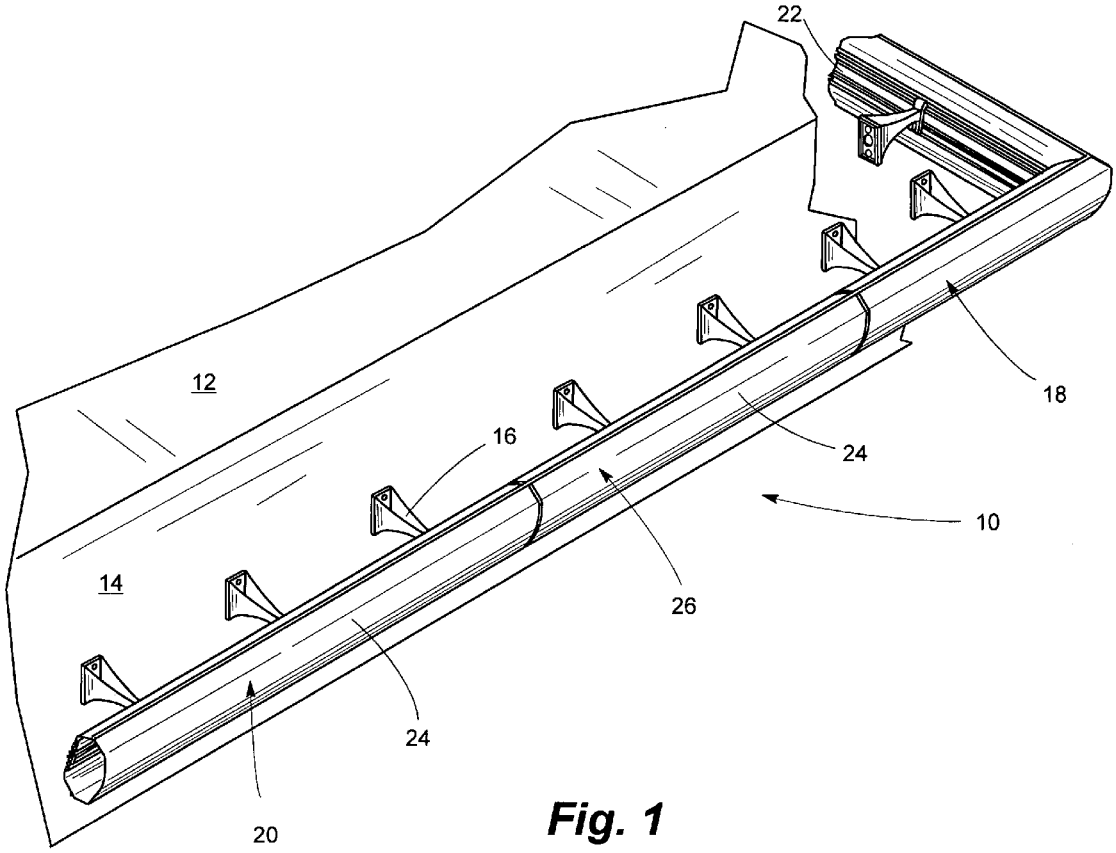
FIG. 1 is an idealized perspective view of a partially assembled illuminated sign configured according to the invention and mounted to a building structure.

Referring now to the drawings and particularly to FIG. 1, an illuminated sign is seen at 10 to be configured according to the invention and is seen to be mounted to a building face 12 in juxtaposition to a reflective fascia 14 by means of mounts 16 which are mounted to or through the fascia 14 to the face 12 of a building. The sign 10 is seen in an installation on a canopy of a service station or the like. The illuminated sign 10 functions primarily to provide a visual affect intended to be decorative and also to identify at least in certain situations a particular commercial presence that is associated with the form of the illuminated sign 10 and also with coloration of the sign 10 and of the fascia 14. It is to be understood that an installation need not be provided with the reflective fascia 14 as desired according to the exigencies of a particular situation. The sign 10 is formed of an illuminated a corner section 18 as well as at least one illuminated sections 20, the sections 20 being essentially identical and being mounted in end-to-end relation to form a length of such sections 20 so that the sign 10 can extend across a given dimension of the building face 12.

The mounts 16 attach in a conventional manner to an elongated track strip 22 which also mounts a translucent cover 24, seen best in FIG. 1 relative to mounting of the corner section 18. The strip 22 of the corner section 18 is essentially identical in structure and function to the track strip 22 used with the sections 20. The translucent cover 24 is formed of a material, usually a colored material, which diffuses light from light sources carried on outermost faces of the track strip 22, these light sources being seen in other drawing figures. The material from which the translucent cover 24 is formed is conventional in the art and provides a pleasing appearance when illuminated from interiorly thereof by appropriate light sources carried inter alia by the track strip 22.

Figure 2:
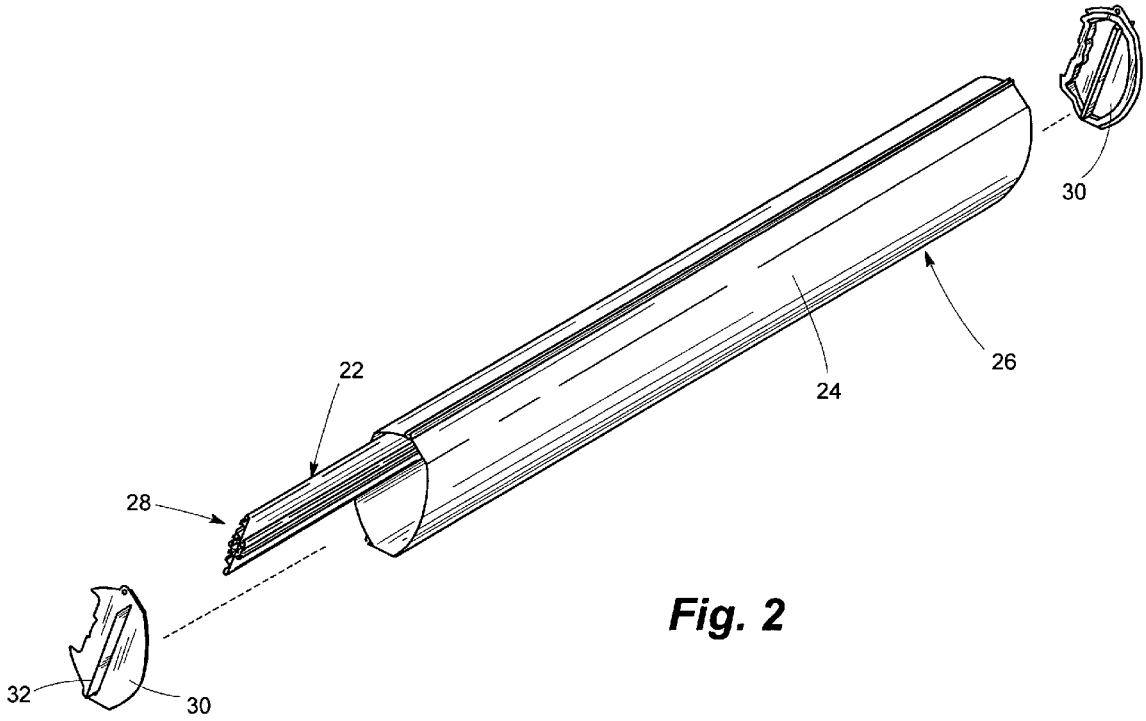
FIG. 2 is a perspective view partially exploded illustrating a section of the sign of FIG. 1 and which is capable of being cut to particular dimensions.

It is an intent of the invention to provide illuminated sections 20 of standard lengths, each such section 20 being capable of modification by trimming of the track strip 22 and of the translucent cover 24 to a lengthwise dimension which permits a section 20 altered by trimming to fit into a length of the sections 20 forming a part of the illuminated sign 10 such that particular dimensions of an installation can be accommodated. In other words, each of the sections 20 is typically of a given length in a particular installation. However, one of the sections 20 will normally require reduction of its length such as by trimming of the track strip 22 and of the cover 24 so that the trimmed section 20 can be fitted into a succession of the sections 20 in order that a given lengthwise dimension of the sign 10 can be produced to yield a desired lengthwise dimension for the entire assembly. Although only one of the sections 20 need be trimmed under usual circumstances, all of the sections 20 are essentially identical and capable of being cut to size for the sake of convenience. In order to differentiate the section 20 of FIG. 1 which is trimmed for the purposes herein described, the trimmed section of FIG. 1 is now referred to as trimmed section 26, the trimmed section 26 being best shown in FIG. 2. The track strip 22 of the trimmed section 26 of FIG. 2 is seen to have been cut at 28 such as by a saw or other cutting implement, a portion (not shown) of the track strip 22 having been removed from said strip 22. The cover 24 has similarly been trimmed to the same length and is shown displaced from a completely covering position relative to the strip 22 for illustration. As is obvious to a person of skill in the art, the lengthwise portion of the strip 22 which is cut away depends upon the length of the section 26 required to accommodate a particular length of a succession of the sections 20, including the trimmed section 26, in a particular installation. As aforesaid, the translucent cover 24 of the trimmed section 26 as is seen in FIG. 2 is also cut to a dimension which is essentially equal to the lengthwise dimension of the trimmed track strip 22 of FIG. 2. The trimmed translucent cover 24 of the trimmed section 26 mounts in sliding relation to the track strip 22 and can be slid along said track strip 22 for cutting off of an end portion of said cover 24, the cover 24 then being slidable back along and/or onto the strip 22 for installation. The cover 24 is seen to have end caps 30 at both ends which snap-fit onto said cover 24. Each of the end caps 30 have a projection 32 extending from an outer face thereof, the projections 32 aligning with and abutting adjacent projections on end caps of adjacent sections 20 to facilitate maintaining the sections 20, and the trimmed section 26, in alignment within an installation.

Figure 7:
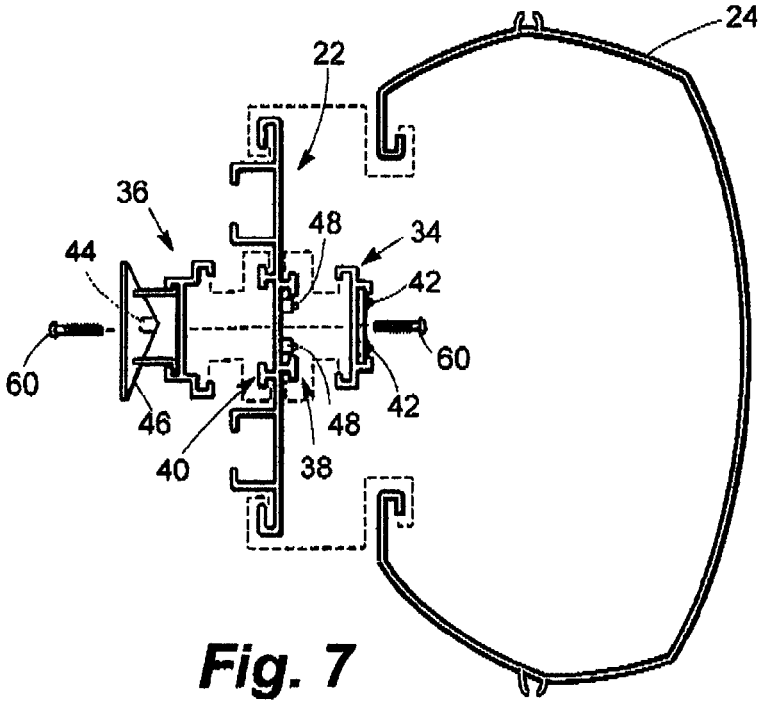

Front and rear sliding elements 34 and 36 are configured to be received onto tracks 38 and 40 formed on the track strip 22 as is best seen in FIG. 7, the sliding elements 34, 36 being movable along the tracks 38, 40 respectively, such that the sliding elements 34, 36 can be positioned as desired along any portion of the track strip 22. The front sliding element 34 is provided with light emitting diodes 42 spaced along the length of the sliding element 34, the light emitting diodes 42 directing light outwardly of the track strip 22 to cause the translucent cover 24 to glow and typically provide a colored glow dependent upon the material from which the translucent cover 24 is formed. Similarly, the rear sliding element 36 is provided on its outer face with a plurality of light emitting diodes 44 each mounted in relation to a reflector 46 to direct light rearwardly of the sections 20 or of the trimmed section 26 so that the light thereby provided is reflected by the reflective fascia 14 mounted to the building face 12 as seen in FIG. 1. The material from which the reflective fascia 14 is formed and particularly the color thereof causes the reflective fascia 14 to reflect a colored light which can be the same or different from the color of the light passing through the translucent cover 24. The resulting illumination, which essentially takes the form of a glow and which does not materially contribute to illumination of spaces surrounding the illuminated sign 10, is useful primarily for providing a visual affect associated with a commercial function occurring at the location of the illuminated sign 10. Although not shown in FIG. 2, light emitting diodes are provided along a portion of both faces of the track strip 22 as described hereinafter, these light emitting diodes functioning essentially in the manner of the light emitting diodes 42, 44, to contribute to the same visual effect. Light emitting diodes are not provided on that portion of the track strip 22 which can be trimmed and over which the sliding elements 34, 36 are intended to move.

Figure 3:
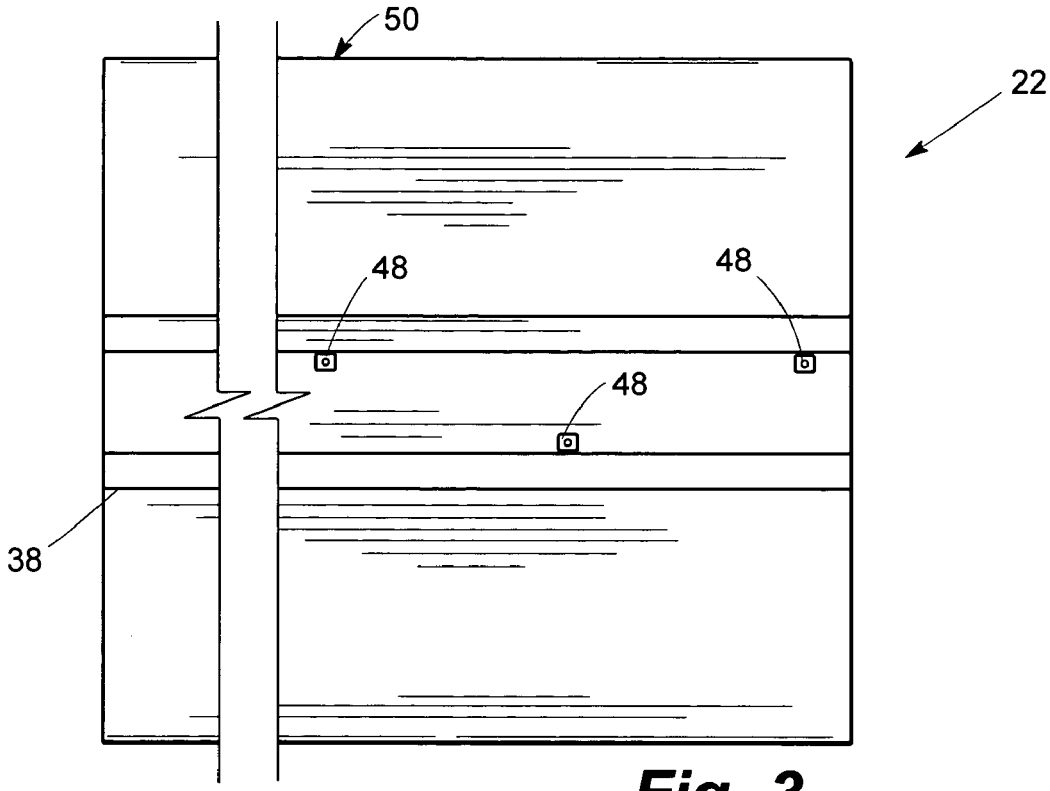
FIG. 3 is a front elevational view of an elongated track strip which acts to mount a translucent cover and light sources according to the invention.

Referring now to FIG. 3, the track strip 22 is seen prior to any trimming thereof to have light emitting diodes 48 formed on outer surfaces thereof and centrally thereof as well as toward one end of said strip 22. One end 50 of the track strip 22, that is, that end which is intended for trimming as described herein, is not provided with any of the light emitting diodes 48.

Figure 4:
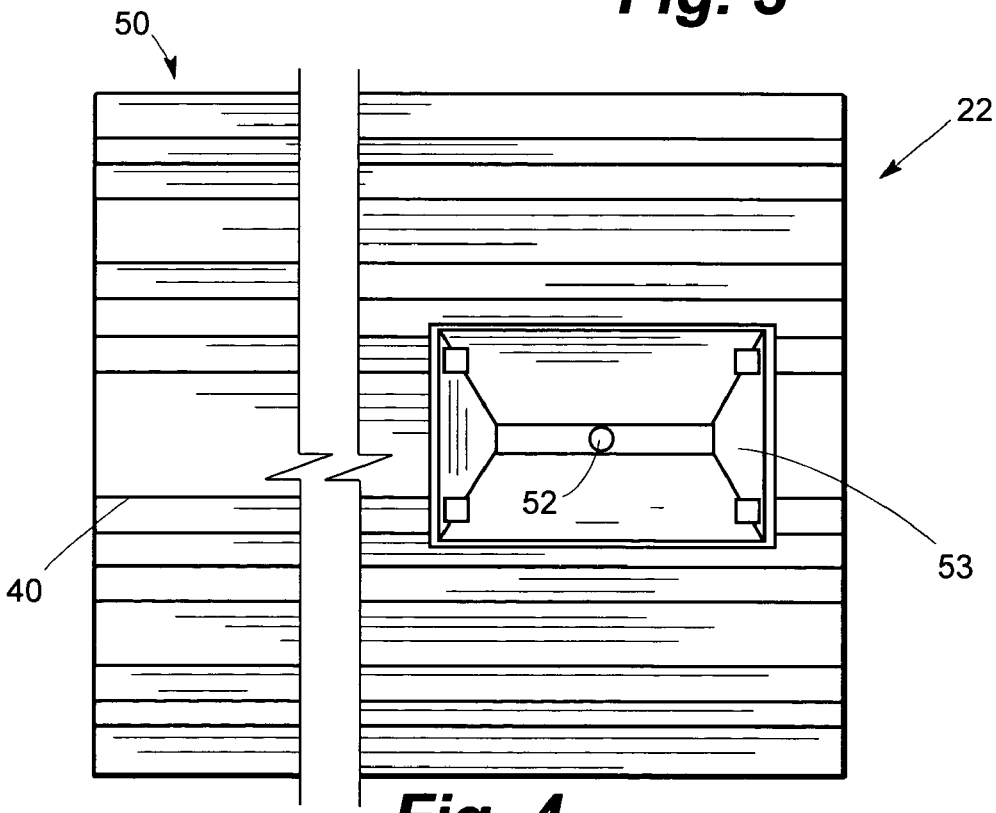
FIG. 4 is a rear elevational view of the elongated track strip.

Referring now to FIG. 4, the track strip 22 is seen to have light emitting diodes 52 disposed over portions of a rear face thereof, the light emitting diodes 52 not being provided on rear surfaces of the end 50 since the end 50 is potentially trimmable to size as is described herein. The light emitting diodes 48 formed on the front face of the track strip 22 as seen in FIG. 3 produce light which passes through the translucent cover 24 in order to give the affect described herein. Similarly, the light emitting diodes 52 located on the rear face of the track strip 22 directs light backwardly toward the reflective fascia 14 seen in FIG. 1 in order to provide the affect described herein. Reflectors 53 associated with the diodes 52 increase efficiency of reflection onto the fascia 14.

Figure 5:
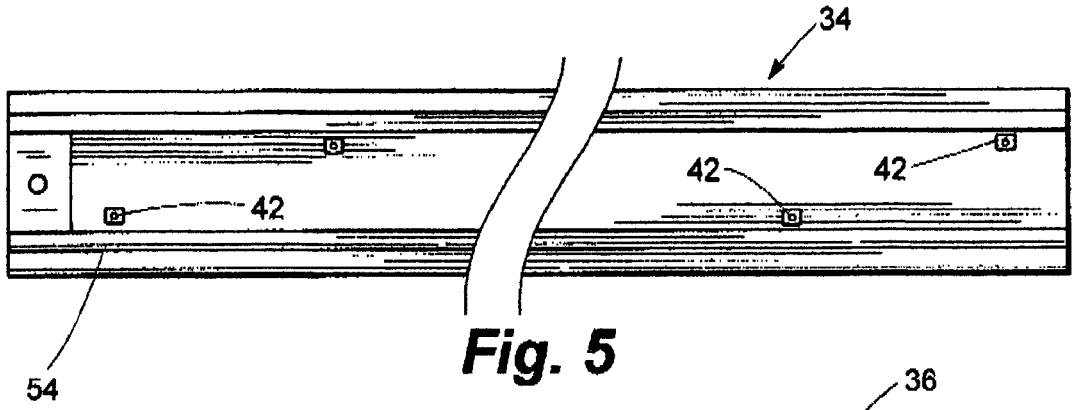
FIG. 5 is a front elevational view of a first sliding adjustment element configured according to the invention and having a light source mounted thereby.
Figure 6:
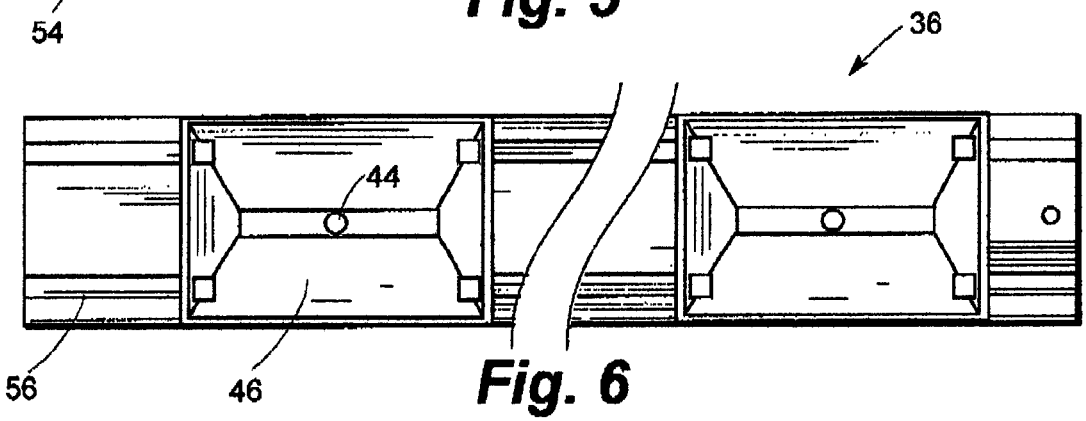
FIG. 6 is a front elevational view of a second adjustment sliding element configured according to the invention; and, FIG. 7 is a side elevational view of the elongated track strip of the invention with the first and second adjustment sliding elements in an assembly relation thereto.

FIGS. 5 and 6 respectively illustrate the front and rear sliding elements 34, 36 on which the respective light emitting diodes 42, 44 are disposed. The sliding elements 34, 36, as can also be seen from a consideration of FIG. 7, have respective track elements 54 and 56 which respectively engage and ride on respective front and rear track elements 58, 60 formed on the track strip 22 in a conventional manner. Accordingly, the front and rear sliding elements 34, 36 are enabled to move along the track strip 22 and to be positioned at particular locations thereof as is desired depending upon whether and to what dimension the track strip 22 is cut. Although not shown in the drawings, electrical power is provided to the light emitting diodes 42, 44 disposed on the sliding elements 36, 38 by means of extendible electrical cords (not shown), power being derived from the power source which operates the light emitting diodes 48, 52 mounted to the track strip 22.

In an installation such as that shown in FIG. 1, the illuminated sign 10 is seen to be formed of at least one of the illuminated sections 20, such sections 20 not being trimmed within the installation illustrated. Sections such as the untrimmed sections 20 are configured in such installations such that the sliding elements 34 and 36 are positioned over the full extent of the end 50 of the track strip 22 which is not provided with light emitting diodes thereon, illumination from that end 50 of the track strip 22 and thus that end of the section 20 being provided by the light emitting diodes 42, 44 mounted by the sliding elements 34, 36 respectively. In the trimmed canopy section 26, inward portions of each of the sliding elements 34, 36 overlap portions of the track strip 22 which have the light emitting diodes 48, 52 carried thereon since the sliding elements 34, 36 cannot be positioned to a full range of motion outwardly along the track strip 22 due to the fact that the track strip 22 has been reduced in lengthwise dimension. The sliding elements 34, 36, once properly located, can be fixed in position by means of simple set screws 60 or the like.

While the invention has been explicitly described herein relative to one particular embodiment thereof, it is to be understood that the structure of the invention can take a variety of forms other than that shown. The track strip 22 and the sliding elements 34, 36 can be configured in a variety of confirmations including the nature of track elements used for relative movement therebetween. Further, it is to be understood that the invention can be used to provide an illuminated sign for fast food restaurants and the like as well as in indirect lighting and similar applications. Accordingly, it is to be understood that the invention can be practiced other than as is explicitly described herein without departing from the scope of the invention defined by the recitations of the appended claims.

What is claimed is:

1. An illuminated sign formed of sections and having at least one light source carried by each of the sections to illuminate at least portions of each section, each section forming the illuminated sign being disposable in relation to adjacent sections to form an elongated succession of said sections, each section being essentially identical and being reducible in length to cause said succession of sections to assume a desired lengthwise dimension, and means carried by each section for permitting removal of a portion of each said section without altering the affects of the illumination provided by the light source, said means comprising means having at least one light source carried thereon and being movably mounted to the section for adjusting the position of the at least one light source to provide even illumination of the section whether or not said sections is trimmed from a predetermined manufactured length, each section comprising a translucent cover and a mounting strip to which the cover is mounted, a plurality of light emitting diodes being mounted to the mounting strip to direct light through the cover, the adjusting means comprising a second strip mountable for movement along the mounting strip and carrying at least one light emitting diode to direct light through the cover, the second strip being movable along a portion of the mounting strip which can be trimmed to alter the length of the section.

2. The illuminated sign of claim 1 and further comprising a third strip mountable for movement along the mounting strip and carrying at least one light emitting diode to direct light rearwardly of the section, the third strip being movable along the portion of the mounting strip which can be trimmed to alter the length of the section.

3. The illuminated sign of claim 2 wherein a plurality of light emitting diodes are mounted to a rear face of the mounting strip oppositely to the first-mentioned light emitting diodes mounted thereto, the light emitting diodes mounted to the rear face of the mounting strip directing light rearwardly of the section.

4. The illuminated sign of claim 3 and further comprising means disposed rearwardly of the section and adjacent thereto for reflecting light directed thereon by the light emitting diodes carried by the mounting strip on the rear face thereof and by the third strip.

5. The illuminated sign of claim 4 and further comprising means assocaited with at least certain of the light emitting diodes for reflecting light emanating from the light emitting diodes.

6. The illuminated sign of claim 1 wherein the mounting strip comprises an elongated planar body member having track elements formed on opposite planar faces thereof, at least certain of the track elements mounting the translucent cover for movement along said mounting strip, at least certain other of the track elements mounting the second and third strips respectively for movement along the mounting strip.

7. The illuminated sign of claim 1 and further comprising means associated with at least certain of the light emitting diodes for reflecting light emanating from the light emitting diodes.

8. The illuminated sign of claim 1 and further comprising end caps mountable to ends of each section, each end cap having an elongated projection extending outwardly of the section therefrom, the end caps from adjacent sections abutting to facilitate maintaining the alignment of the sections.

9. The illuminated sign of claim 1 wherein the translucent cover is formed of a material which produces a desired color on passage of light therethrough.

10. A luminaire formed of sections and having at least one light source carried by each of the sections to illuminate at least portions of each section, each section forming the luminaire being disposable in relation to adjacent sections to form an elongated succession of said sections, each section being essentially identical and being reducible in length to cause said succession of sections to assume a desired lengthwise dimension, and means carried by each section for permitting removal of a portion of each said section without altering the affects of the illumination provided by the light source, said means comprising means having at least one light source carried thereon and being movably mounted to the section for adjusting the position of the at least one light source to provide even illumination of the section whether or not said section is trimmed from a predetermined manufactured length, each section comprising a translucent cover and a mounting strip to which the cover is mounted, a plurality of light emitting diodes being mounted to the mounting strip to direct light through the cover, the adjusting means comprising a second strip mountable for movement along the mounting strip and carrying at least one light emitting diode to direct light through the cover, the second strip being movable along a portion of the mounting strip which can be trimmed to alter the length of the section.

11. The luminaire of claim 10 wherein the luminaire comprises an indirect lighting fixture.

12. An illuminated sign formed of sections, at least certain of the sections having at least one light source carried by said at least certain of the sections, each section forming the illuminated sign being disposable in relation to adjacent sections to form a succession of sections, at least certain of the sections being reducible in at least one dimension to cause said succession of sections to assume a desired dimension in said at least one dimension, and means carried by at least certain of the sections for permitting removal of a portion of each said section without altering the affects of the illumination provided by any one light source, said means comprising means having at least one light sources carried thereon and being movably mounted to the section for adjusting the position of the at least one light source to provide even illumination of the section whether or not said section is trimmed from a predetermined manufactured dimension, each section comprising a translucent cover and a mounting strip to which the cover is mounted, a plurality of light emitting diodes being mounted to the mounting strip to direct light through the cover, the adjusting means comprising a second strip mountable for movement along the mounting strip and carrying at least one light emitting diode to direct light through the cover, the second strip being movable along a portion of the mounting strip.

13. The illuminated sign of claim 12 wherein the dimension of the sections is a length-wise dimension.

14. The illuminated sign of claim 12 and further comprising a third strip mountable for movement along the mounting strip and carrying at least one light emitting diode to direct light rearwardly of the section, the third strip being movable along the portion of the mounting strip.

15. The illuminated sign of claim 14 wherein a plurality of light emitting diodes are mounted to a rear face of the mounting strip oppositely to the first-mentioned light emitting diodes mounted thereto, the light emitting diodes mounted to the rear face of the mounting strip directing light rearwardly of the section.

16. The illuminated sign of claim 15 and further comprising means disposed rearwardly of the section and adjacent thereto for reflecting light directed thereon by the light emitting diodes carried by the mounting strip on the rear face thereof and by the third strip.

17. The illuminated sign of claim 16 and further comprising means associated with at least certain of the light emitting diodes for reflecting light emanating from the light emitting diodes.

18. The illuminated sign of claim 12 wherein the mounting strip comprises an elongated planar body member having track elements formed on opposite planar faces thereof, at least certain of the track elements the translucent cover for movement along said mounting strip, at least certain other of the track elements mounting the second and third strips respectively for movement along the mounting strip.

19. The illuminated sign of claim 12 and further comprising means associated with at least certain of the light emitting diodes for reflecting light emanating from the light emitting diodes.

20. The illuminated sign of claim 12 and further comprising end caps mountable to ends of each section, each end cap having an elongated projection extending outwardly of the section therefrom, the end caps from adjacent sections abutting to facilitate maintaining the alignment of the sections.

21. The illuminated sign of claim 12 wherein the translucent cover is formed of a material which produces a desired color on passage of light therethrough.

22. The illuminated sign of claim 12 wherein each section carries at least one of the light sources.

23. The illuminated sign of claim 12 wherein each section is essentially identical prior to any reduction in dimension.

24. The illuminated sign of claim 12 wherein the dimension is a length-wise dimension and the sections form an elongated succession of sections.

25. The illuminated sign of claim 24 wherein each section has a predetermined manufactured length.

26. The illuminated sign of claim 25 wherein each section has an identical length.

27. A method for adjusting a dimension of a section of an illuminated sign comprised of sections having at least one light source carried by at least certain of the sections, each section being disposable in relation to adjacent sections to form a succession of sections, each section comprising a cover and a mounting strip to which the cover is mounted, the at least one light source being mounted to the mounting strip for direction of light through the cover, at least on e adjusting strip mountable for movement along the mounting strip of at least one of the sections and carrying at least one light source for direction of light through the cover, the at least one adjusting strip being movable along the mounting strip, comprising the steps of:

reducing a dimension of at least one of the sections to fit a desired configuration of the illuminated sign; and, displacing the at least one adjusting strip on the at least one of the sections relative to the mounting strip to conform to the reduced dimension of the section.

28. The method of claim 27 wherein the light source comprises at least one light emitting diode.

29. The method of claim 27 wherein the dimension is a length-wise dimension.

30. The method of claim 27 wherein the step of reducing a dimension of the section comprises the step of reducing a dimension of the cover.

31. The method of claim 30 wherein the light source comprises at least one light emitting diode and the dimension is a length-wise dimension.

32. The method of claim 27 wherein the step of reducing the length-wise dimension of the cover comprises the step of trimming the length of the cover.

* * * * *